US011103421B1

(12) United States Patent
Madigan et al.

(10) Patent No.: US 11,103,421 B1
(45) **Date of Patent: *Aug. 31, 2021**

(54) SYSTEM AND APPARATUS FOR HOLDING VIALS

(71) Applicants: Richard Madigan, Hingham, MA (US); Connor Madigan, Foxborough, MA (US)

(72) Inventors: Richard Madigan, Hingham, MA (US); Connor Madigan, Foxborough, MA (US)

(73) Assignee: Accutech Packaging, Inc., Foxboro, MA (US)

( * ) Notice: Subject to any disclaimer, the term of this patent is extended or adjusted under 35 U.S.C. 154(b) by 240 days.

This patent is subject to a terminal disclaimer.

(21) Appl. No.: 16/413,784

(22) Filed: May 16, 2019

(51) Int. Cl.

| | |
|---|---|
| ***A61J 1/16*** | (2006.01) |
| ***F25D 31/00*** | (2006.01) |
| ***B65D 81/38*** | (2006.01) |
| ***B65D 25/10*** | (2006.01) |
| ***A61J 1/14*** | (2006.01) |

(52) U.S. Cl.
CPC ..... *A61J 1/165* (2013.01); *A61J 1/1468* (2015.05); *A61J 1/16* (2013.01); *B65D 25/10* (2013.01); *B65D 81/3823* (2013.01); *F25D 31/006* (2013.01)

(58) Field of Classification Search
CPC ..... A61J 1/165; A61J 1/20; A61J 1/16; B65D 81/3823; B65D 81/3816; B65D 81/3862; B65D 25/10; F25D 31/006
USPC ..... 220/592.25, 592.01; 206/571
See application file for complete search history.

(56) References Cited

U.S. PATENT DOCUMENTS

| | | | | |
|---|---|---|---|---|
| 3,848,766 | A * | 11/1974 | Gantt | B65D 25/287 206/139 |
| 4,628,705 | A * | 12/1986 | Nave | F25D 3/08 62/371 |
| 2004/0200232 | A1* | 10/2004 | Gano, III | B65D 81/3883 62/457.2 |
| 2018/0282049 | A1* | 10/2018 | Tumber | B65D 81/383 |

FOREIGN PATENT DOCUMENTS

| | | | | |
|---|---|---|---|---|
| WO | WO-2013096710 | A1 * | 6/2013 | A01N 1/0263 |

* cited by examiner

*Primary Examiner* — Rafael A Ortiz
(74) *Attorney, Agent, or Firm* — Salter & Michaelson

(57) ABSTRACT

An apparatus for holding one or more vials of a fluid that is to be protected, including an insulator housing that includes separate housing halves that, when joined together, form an internal space and a recess, a two piece carrier that is disposed within the recess formed by the separate housing halves, and a one piece vial rack supported by the two piece carrier. The one piece vial rack has a plurality of vial passages each for accommodating an elongated vial that contains a biological substance.

15 Claims, 24 Drawing Sheets

SYSTEM AND APPARATUS FOR HOLDING VIALS

RELATED CASES

There is a related application filed on even date herewith and including common subject matter. This related application is now hereby incorporated by reference herein in its entirety. This related application has been filed as Ser. No. 16/413,804.

FIELD OF THE INVENTION

The present invention relates in general to a system and apparatus for holding one or more vials of a fluid that is to be protected. The present invention also relates to a system for holding a plurality of vials of a fluid that consists of a biological substance for the purpose of maintaining a predetermined temperature of the biological substance over a predetermined amount of time.

BACKGROUND OF THE INVENTION

The traditional technique for maintaining the temperature of a biological payload employs only convection. This comes about because the function of holding the vials and the cooling/temperature control are two distinct components. For example, one traditional technique employs a paperboard vial tray placed on the top of a block of ice inside of a conventional Styrofoam cooler. Another technique may employ the use of dry ice. In either case the vials do not make contact with the cooling agent and the void space within the cooler simply functions as a convection chamber.

Accordingly, it is an object of the present invention to provide an improved system and apparatus for holding vials of a biological substance or the like for maintaining a predetermined temperature of the biological substance.

Another object of the present invention is to provide a temperature controlled vial rack disposed within an insulator and in which there is virtually no functional void space. This improves the efficiency of the temperature suppressive material as there is direct contact with the payload in the vials.

Still another object of the present invention is to provide an improved system and apparatus for holding a plurality of vials and in which the overall package size is substantially reduced by at least 50 percent. This is possible in accordance with the present invention by combining the functions of the vial holder with the temperature control substance.

SUMMARY OF THE INVENTION

To accomplish the foregoing and other objects, features and advantages of the present invention there is provided an apparatus for holding one or more vials of a fluid that is to be protected. The apparatus is comprised of an insulator housing that includes separate housing halves that, when joined together, form an internal space and a recess, a two piece carrier that is disposed within the recess formed by the separate housing halves, and a one piece vial rack supported by the two piece carrier. The one piece vial rack has a plurality of vial passages each for accommodating an elongated vial that contains a biological substance.

In accordance with other aspects of the present invention:

wherein each insulator housing half is comprised of an insulator base and an insulator lid that are commonly sealed about respective base and lid edges;

wherein each insulator base has an interlocking surface oppositely disposed to the insulator lid, and the respective interlocking surfaces, when the housing halves are joined, are interlocked to maintain the housing halves in place;

including a foam insulating material that is disposed in the internal space provided between the separate housing halves;

wherein the interlocking surfaces include a tongue and groove engagement surface;

wherein the tongue and groove both have interlocking surfaces that alternate along a length of each so that a segment of a groove terminates followed by a segment of a tongue thereafter and in line;

wherein the two piece carrier is comprised of separate carrier halves each having an inner space and a cavity so that when the separate carrier halves are joined the combined cavities of the separate carrier halves are constructed and arranged to receive the one piece vial rack therein;

including a temperature suppressive material that is disposed in the inner space provided between the separate carrier halves;

wherein each insulator housing half is comprised of an insulator base and an insulator lid that are commonly sealed about respective base and lid edges, wherein each insulator base has an interlocking surface oppositely disposed to the insulator lid, and the respective interlocking surfaces, when the housing halves are joined, are interlocked to maintain the housing halves in place, and including a foam insulating material that is disposed in the internal space provided between the separate housing halves;

wherein the interlocking surfaces include a tongue and groove engagement surface;

wherein the tongue and groove both have interlocking surfaces that alternate along a length of each so that a segment of a groove terminates followed by a segment of a tongue thereafter and in line;

wherein the one piece vial rack is comprised of like rack halves that come together to form the plurality of vial passages;

wherein each rack half forms half of each vial passage;

wherein the vial rack has opposed sides and a first set of vial passages of the plurality of vial passages are formed in one of the opposed sides and a second set of vial passages of the plurality of vial passages are formed in another of the opposed sides; wherein each vial is elongated in shape and has a length less than the length of an accommodating vial passage;

including matching glue channels in the respective rack halves;

wherein the matching glue channels are disposed separate from the vial passages;

wherein the rack halves from an internal void area and including temperature suppressive material that fills the internal void area between the rack halves;

wherein the one piece vial rack is comprised of like rack halves that come together to form the plurality of vial passages, and that define therebetween an internal void area; and including a temperature suppressive material that fills the internal void area between the rack halves.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 23:
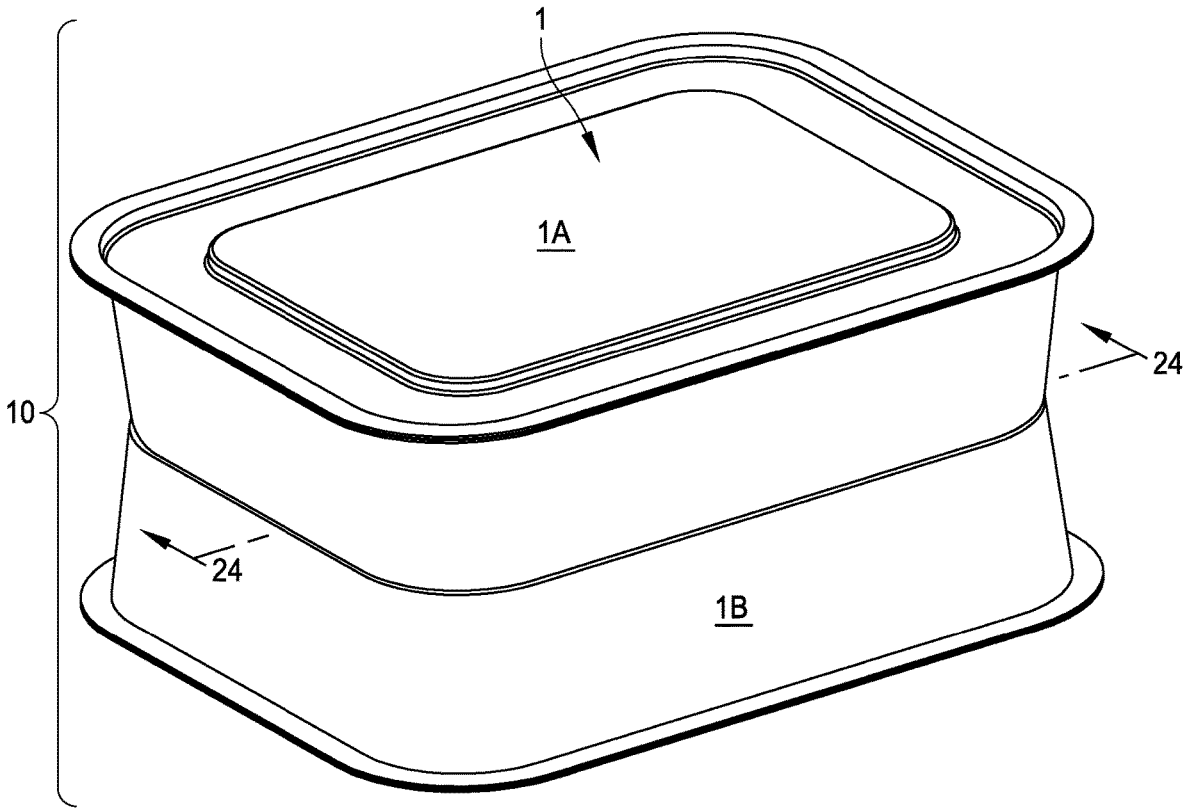
FIG. 23 is a perspective view showing the finally assembled insulator housing.

The temperature control system of the present invention may be considered as comprised of three basic components including an insulator 1, a carrier 6 and a vial rack 7. For the insulator, reference may be made to FIGS. 1-8 as well as FIGS. 23 and 24. For the carrier 6, reference may be made to FIGS. 9-16 and FIG. 24. For the vial rack 7, reference may be made to FIGS. 17-24.

The insulator 1 may be formed of the separate insulator base 2 and insulator lid 3 and may be constructed of a relatively hard plastic material. The two piece carrier 6 is illustrated as comprised of a clear plastic material that is to be filled with a suppressive material. The vial rack 7 is also illustrated as constructed of a clear plastic material and likewise supports therein a suppressive material. A suppressive gel material maintains an innate melting/freeze point specific to payload requirements, which retards change of phase and, therefore, temperature decay in accordance with Newton's Law of Cooling.

Figure 8:
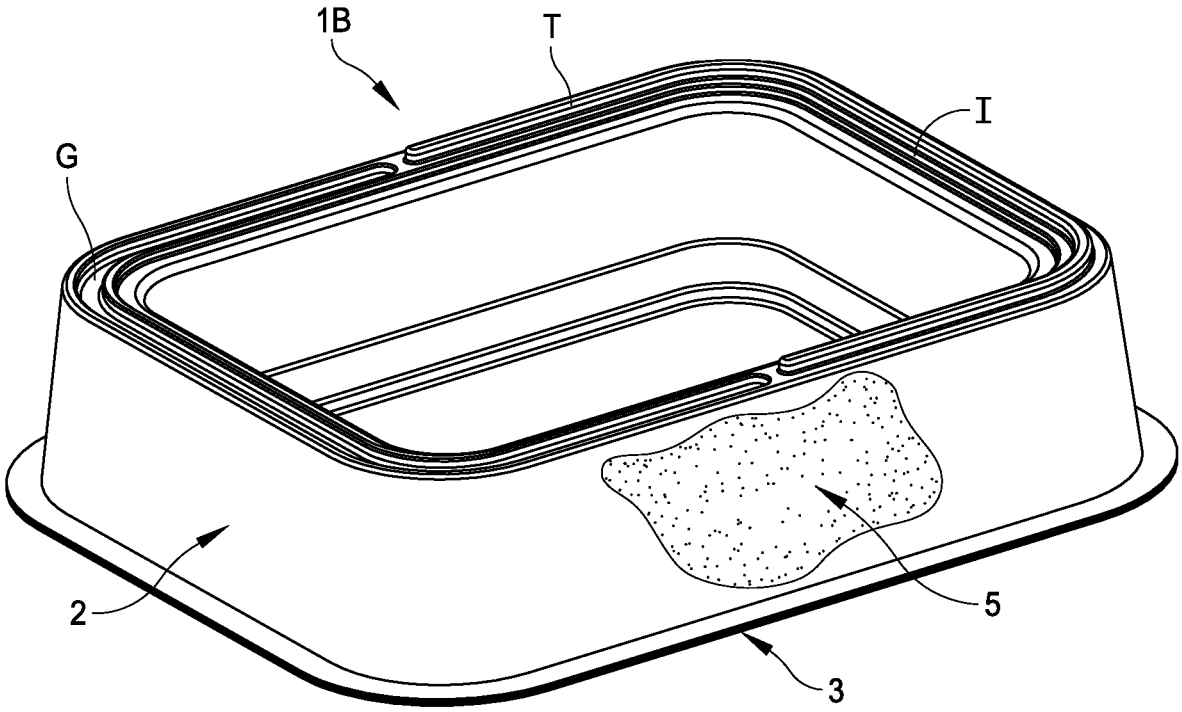
FIG. 8 is a perspective view of the other half of the insulator, also partially cut away to illustrate the internal foam material.

The insulator 1 is comprised of an insulator base 2 and an insulator lid 3. The internal foam material 5 is preferably a high R value urethane foam. This two piece insulator, such as illustrated in FIG. 8, is provided with an interlocking surface I that is comprised on one side of a U-shaped groove G and on the other side a U-shaped tongue T. The other half of the insulator would be provided with a similar tongue and groove arrangement so there is a clear interlock (mating) when the two halves are joined together. The insulator with its internal foam is meant to provide specific temperature profiles with the necessary time duration for biotechnical/pharmaceutical products.

Figure 9:
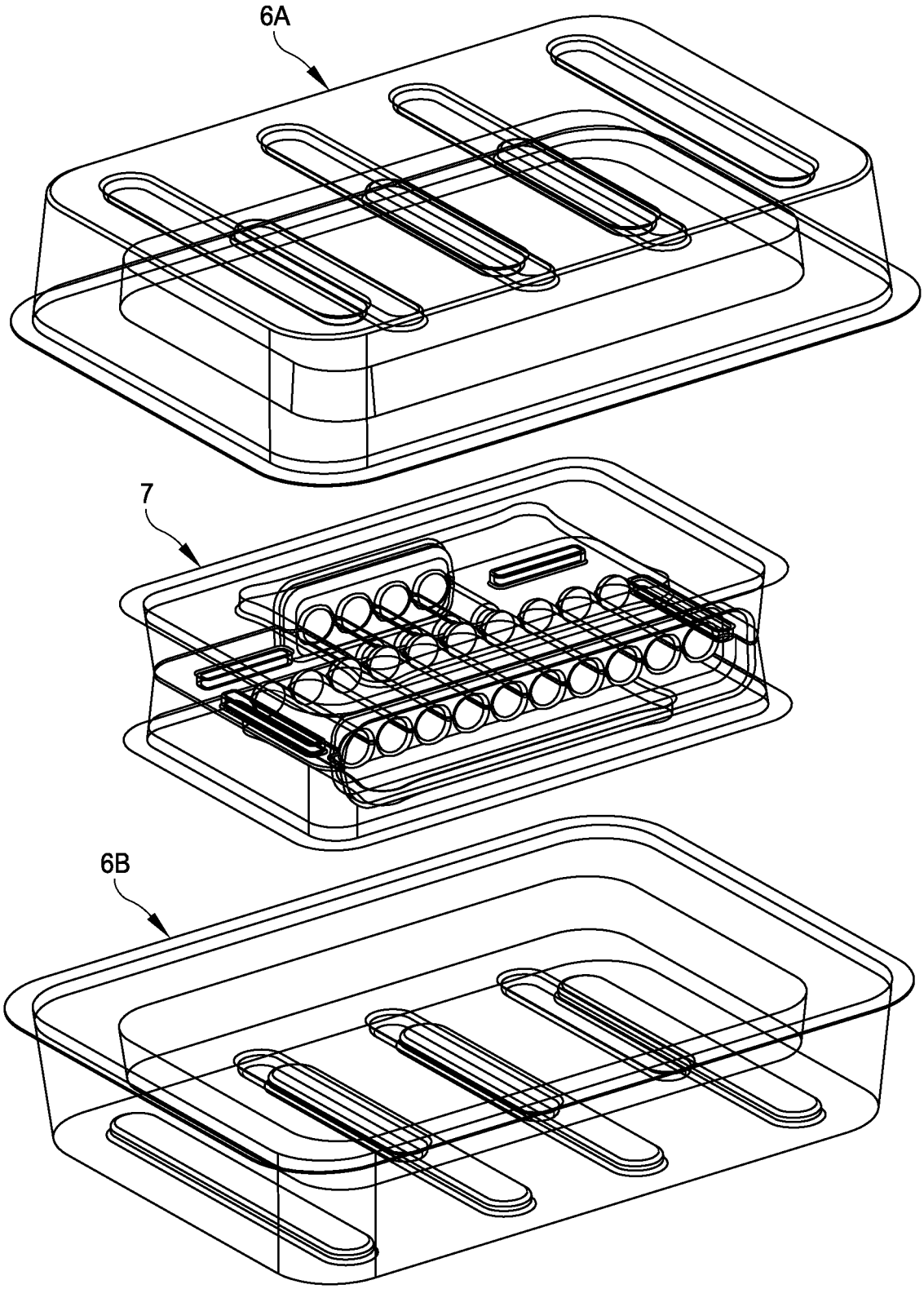
FIG. 9 is an exploded perspective view of the carrier and vial rack.
Figure 10:
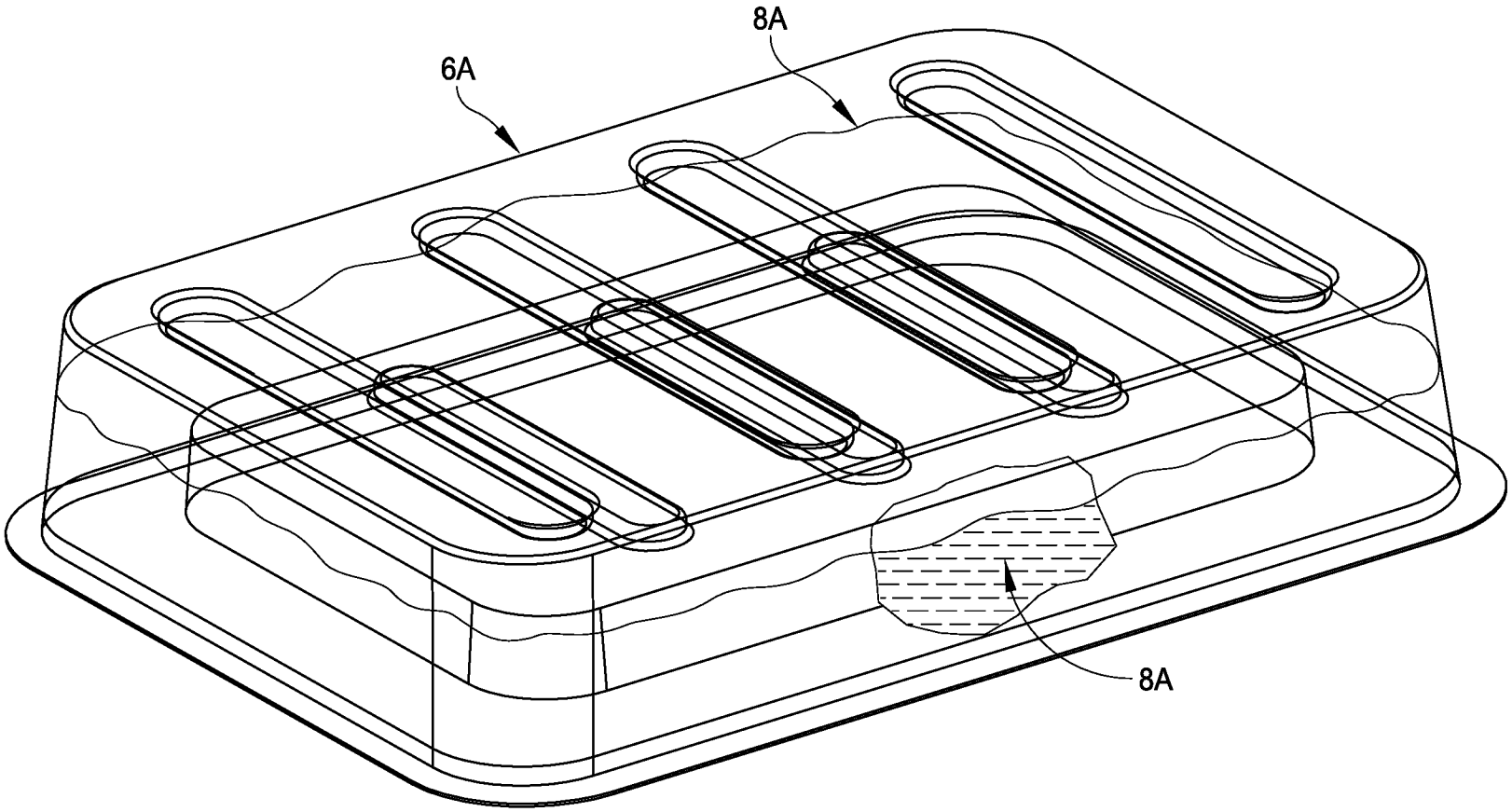
FIG. 10 is a perspective view of one half of the carrier.
Figure 11:
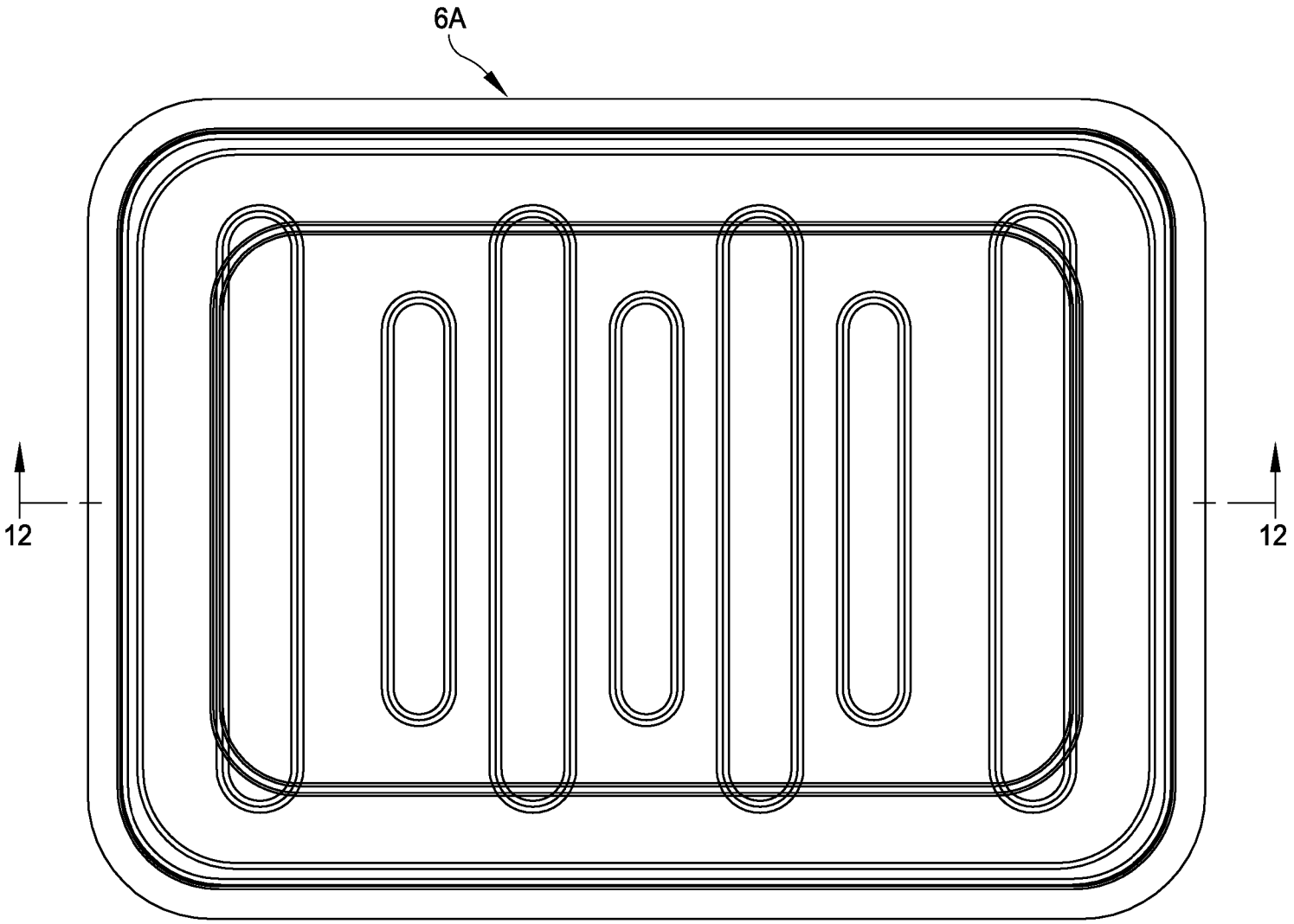
FIG. 11 is a plan view of FIG. 10.
Figure 12:
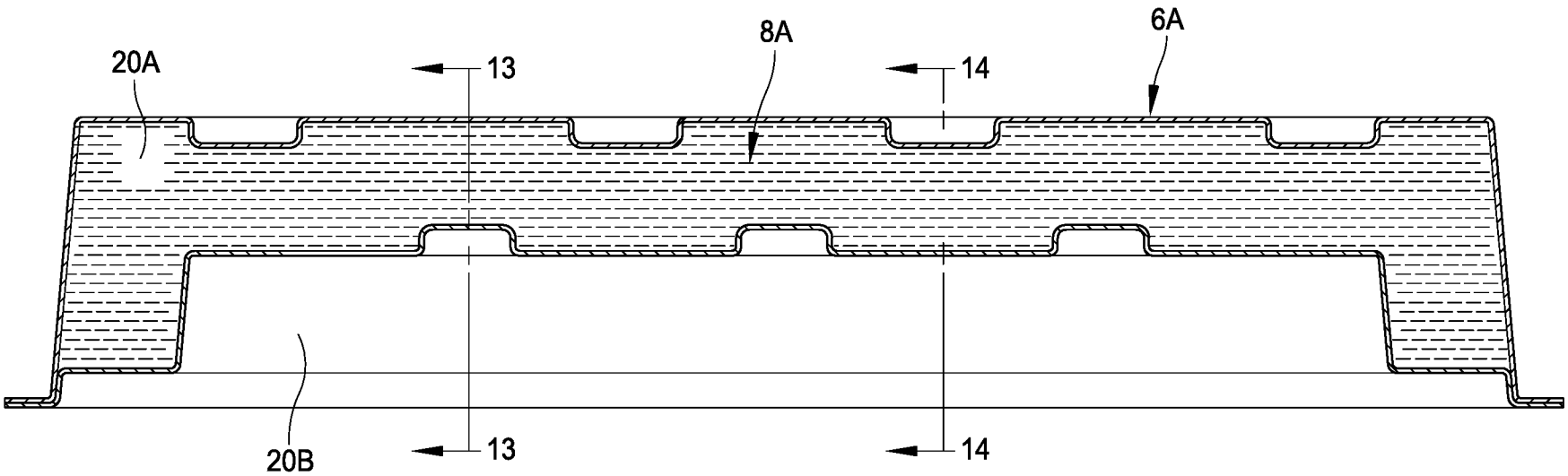
FIG. 12 is a cross-sectional view taken along line 12-12 of FIG. 11.

The carrier 6 is a thermal formed tray filled with a temperature suppressive material such as material 8A depicted in the cross-sectional view of FIG. 12. The two halves 6A and 6B are mated together, but separable and removable from the insulator. The carrier is provided with a cavity for the vial rack as shown in the comprehensive cross-sectional view of FIG. 24. Refer also to FIG. 9 that shows the two carrier halves 6A, 6B with the vial rack 7 disposed between the two halves.

Figure 24:
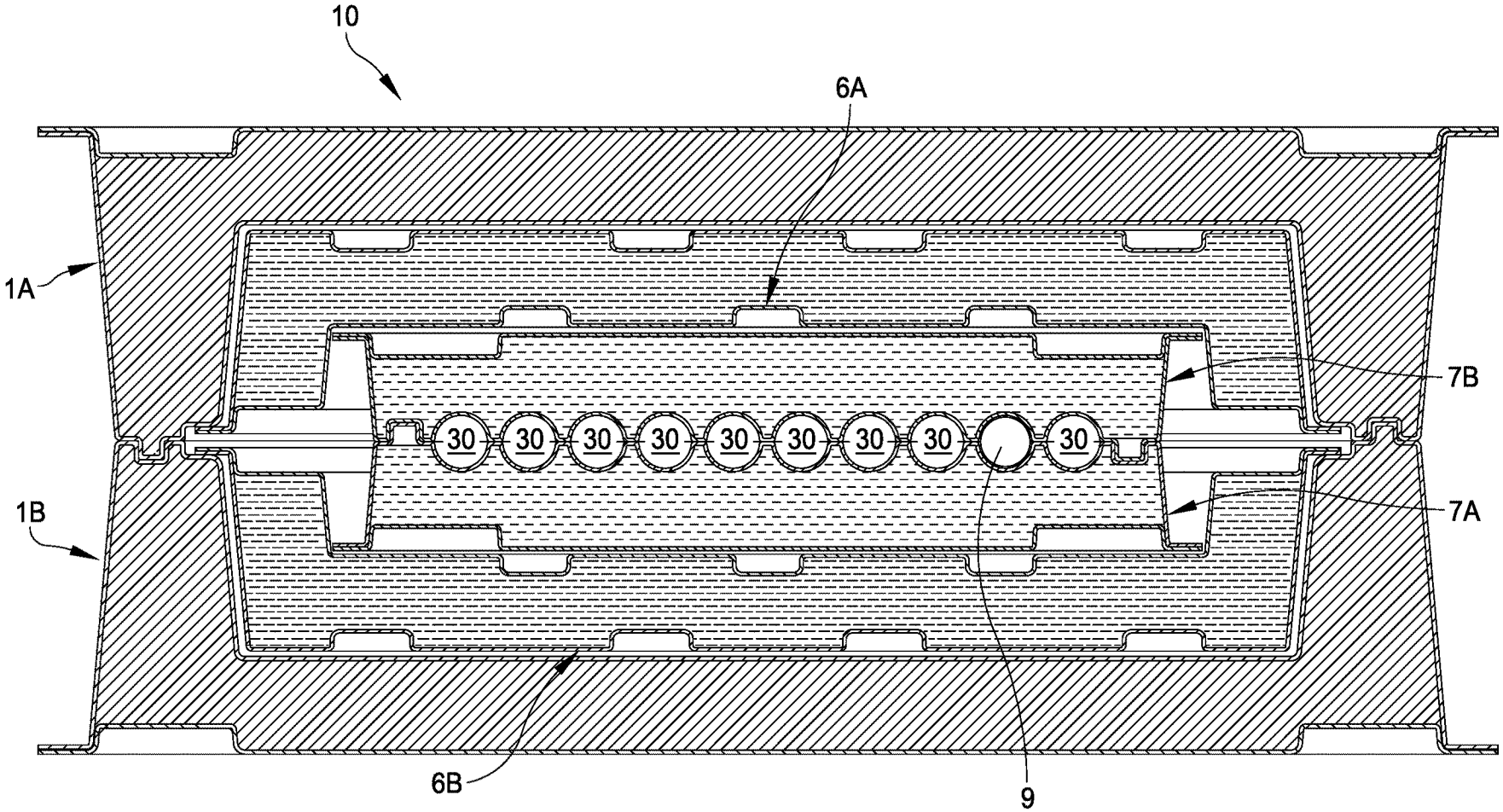
FIG. 24 is a cross sectional view taken along line 24-24 of FIG. 23.

The suppressive material may be used both within the carrier as within the vial rack and is illustrated as such in the cross-sectional view of FIG. 24. This process for introducing the suppressive material into each of these components may occur at the same time or substantially at the same time. In one embodiment four pounds of suppressive material is used to provide 100 percent coverage within both the halves 6 and halves 7. The carrier 6 fits within the insulator 1 utilizing complementary draft angles of both thermal forms to eliminate air gaps, further reducing the overall size of the packet and enhancing insulating properties. The separate halves of the carrier are received within recesses of the insulator and surround the vial rack. Reference to the cross-sectional view of FIG. 24 clearly illustrates the substantial elimination of air gaps, associated with the carrier 6 and rack 7.

Figure 19:
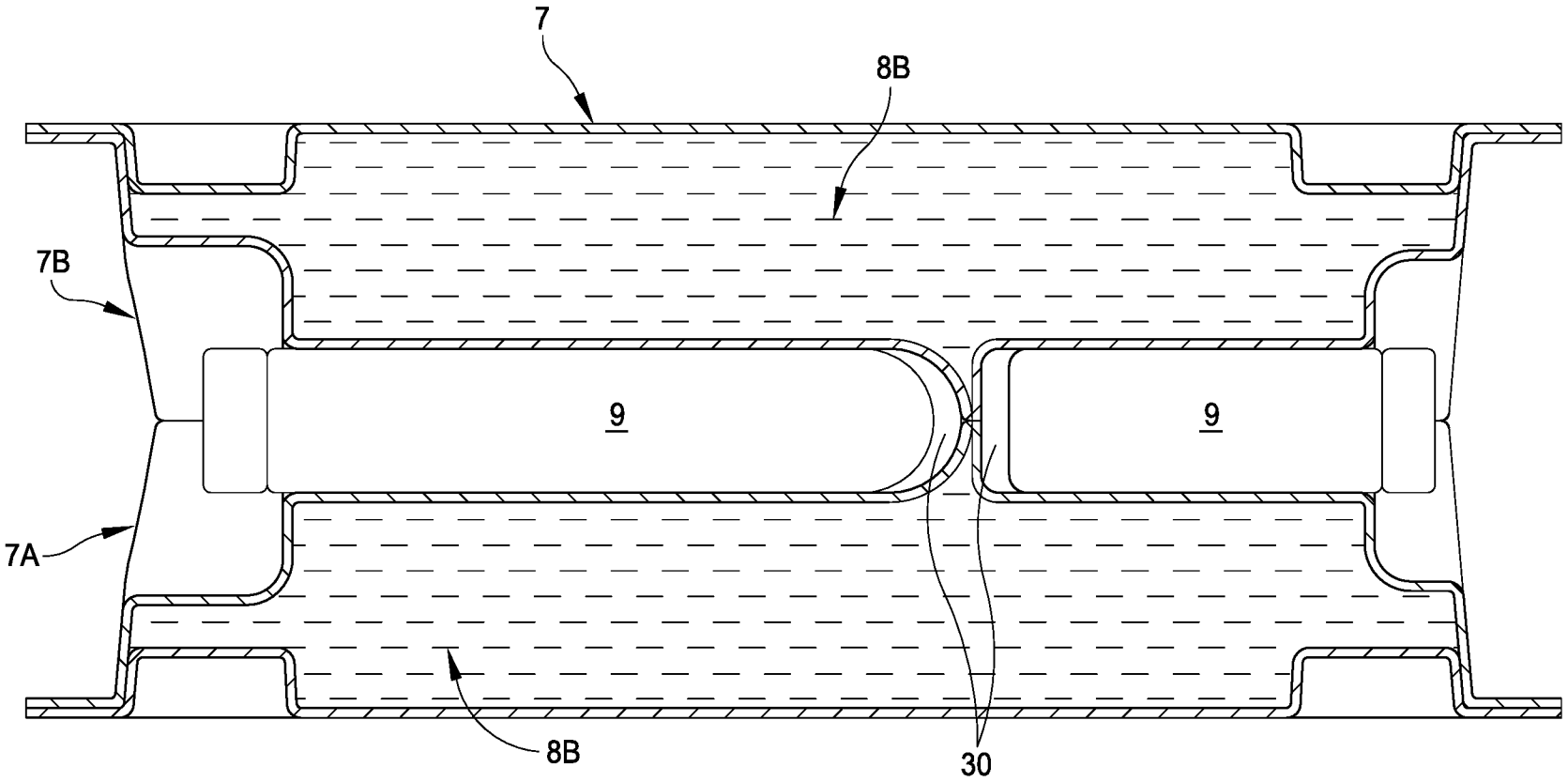
FIG. 19 is a cross-sectional view taken along line 19-19 of FIG. 18.
Figure 19A:
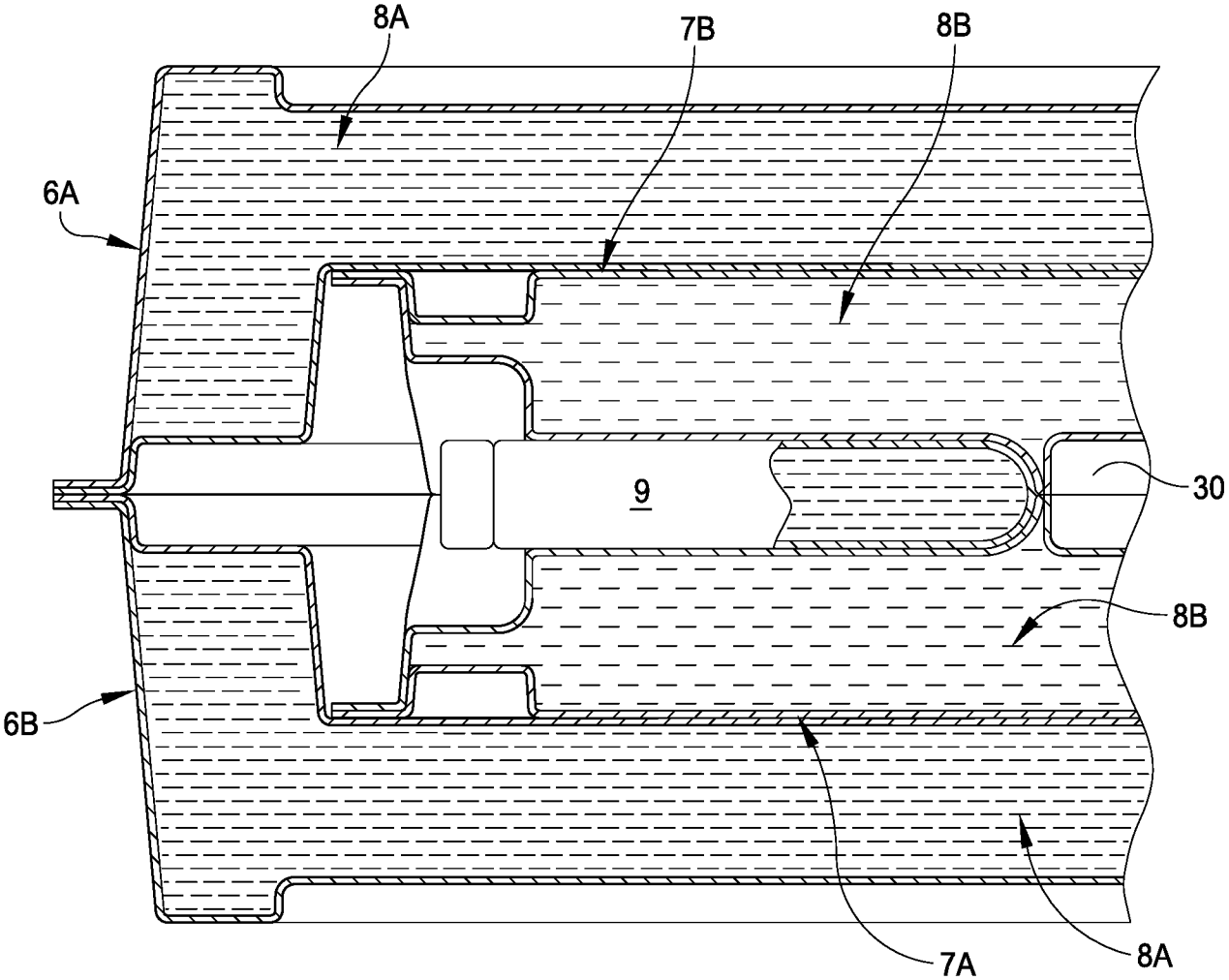
FIG. 19A is an enlarged view showing an end of the carrier and vial rack.
Figure 20:
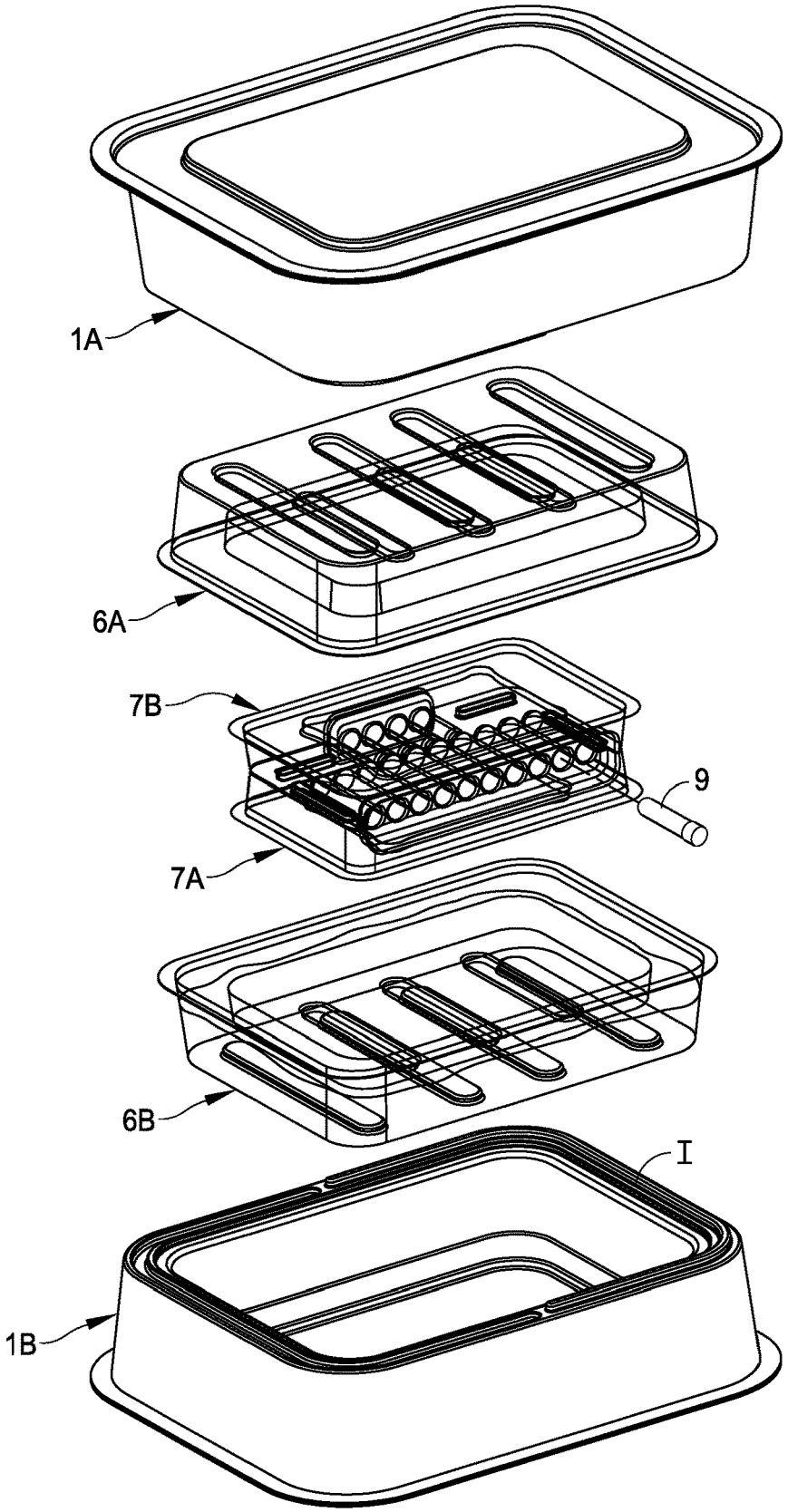
FIG. 20 is an exploded perspective view showing all components including the insulator, carrier and vial rack.
Figure 21:
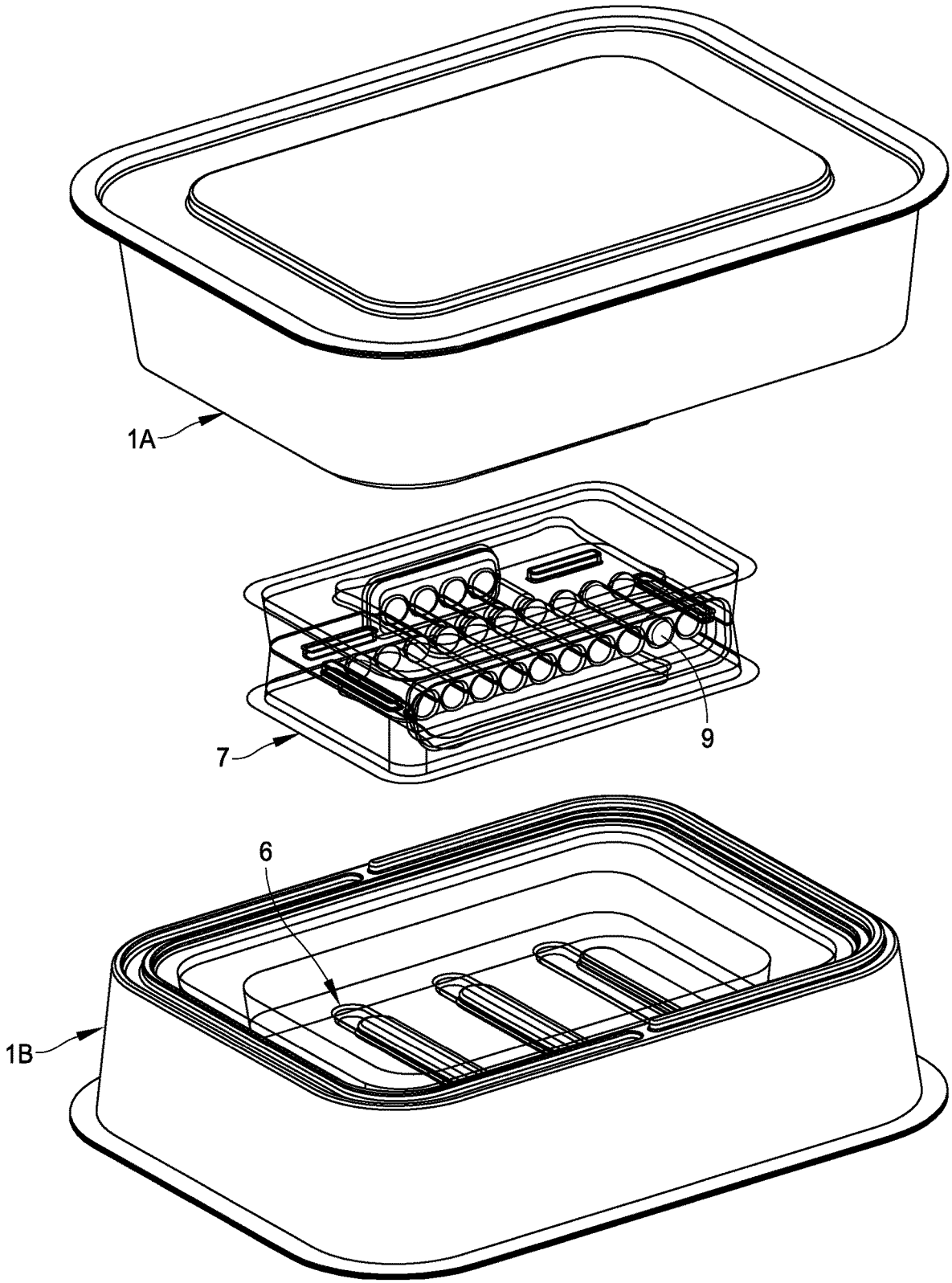
FIG. 21 is a perspective view of the same components as illustrated in FIG. 20 with the carrier and vial rack assembled.
Figure 22:
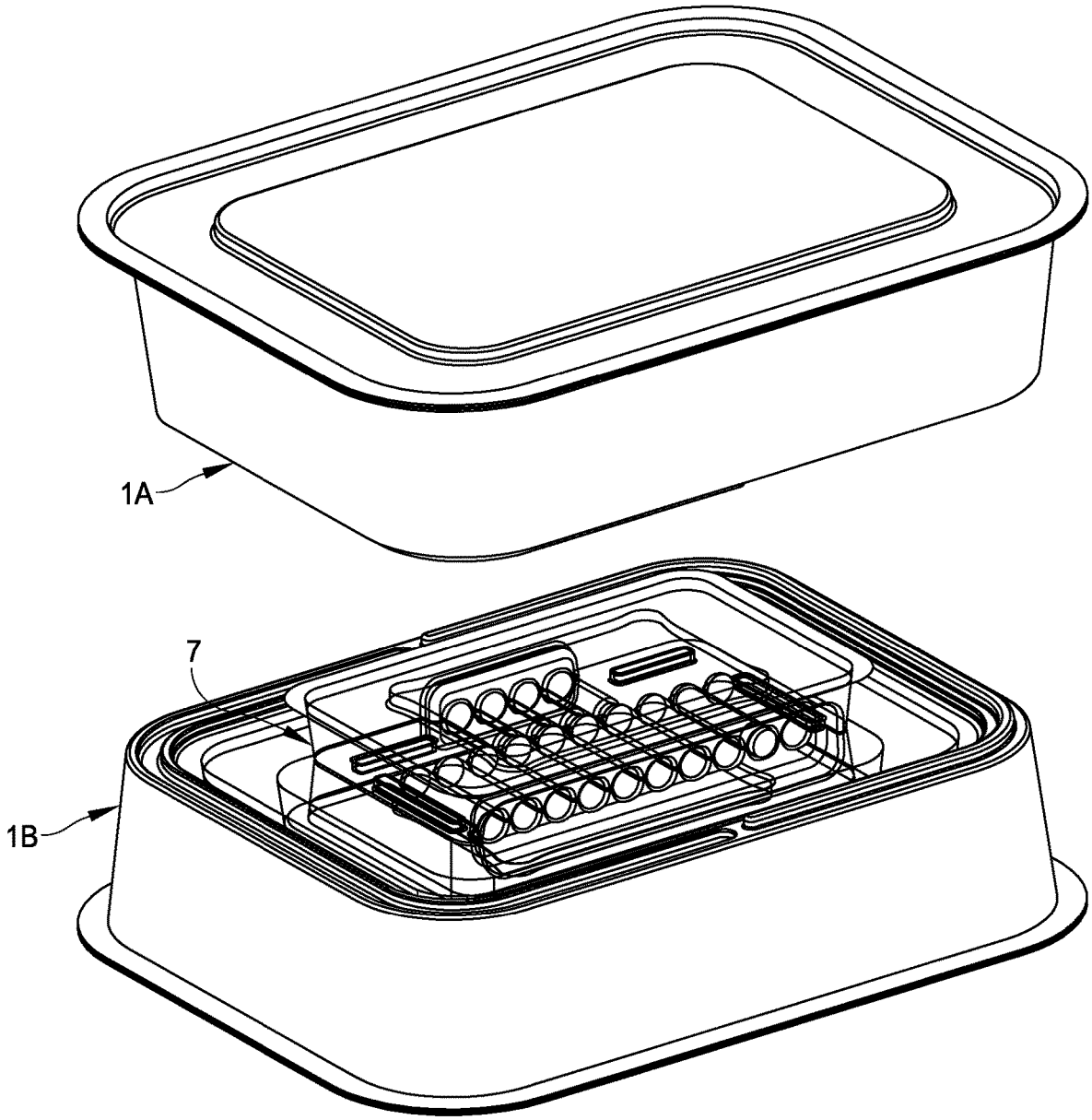
FIG. 22 is a perspective view related to FIGS. 20 and 21 and showing the carrier and vial rack in place within the insulator housing.

As illustrated in the drawings, the vial rack 7 consists of two thermal formed halves or shells 7A and 7B such as illustrated in FIG. 19A and further including glue channels 40 (with applied glue of the desired type) molded into the respective casing. When these vial rack halves are adhered face to face via the glue channels, the shells create multiple passages 30 that accommodate and encapsulate the lower 95 percent of each vial or test tube while at the same time holding the vial or test tube securely within the passage 30. These shells are filled with a temperature suppressive or phase change material, before the molded cap 31 is permanently sealed to the back of this shell creating an airtight chamber that can be conditioned to temperatures as low as −80° C. When no temperature control is necessary, the cap 31 may be sealed to the shell without any suppressive material thus creating an airtight air pocket which functions as an insulating barrier against extreme temperature excursion.

The temperature suppressive material 8B (see FIG. 18) insulates the payload within the vial and maintains a temperature within a desired temperature range for up to 24 hours, thereby successfully protecting any biological payload from decay. Since the shells of the rack hold the vials and the shells are filled with a temperature suppressive material, the vials are making direct contact with the temperature controlling agent, thus utilizing both conduction and convection as methods of thermal transfer. In the embodiment that is illustrated herein the temperature control vial rack preferably has no functional void space which improves the efficiently of the temperature suppressive material (direct contact with the payload) and reduces the overall package size by approximately 50 percent (combining the function of the vial holder with the temperature control substance).

Figure 1:
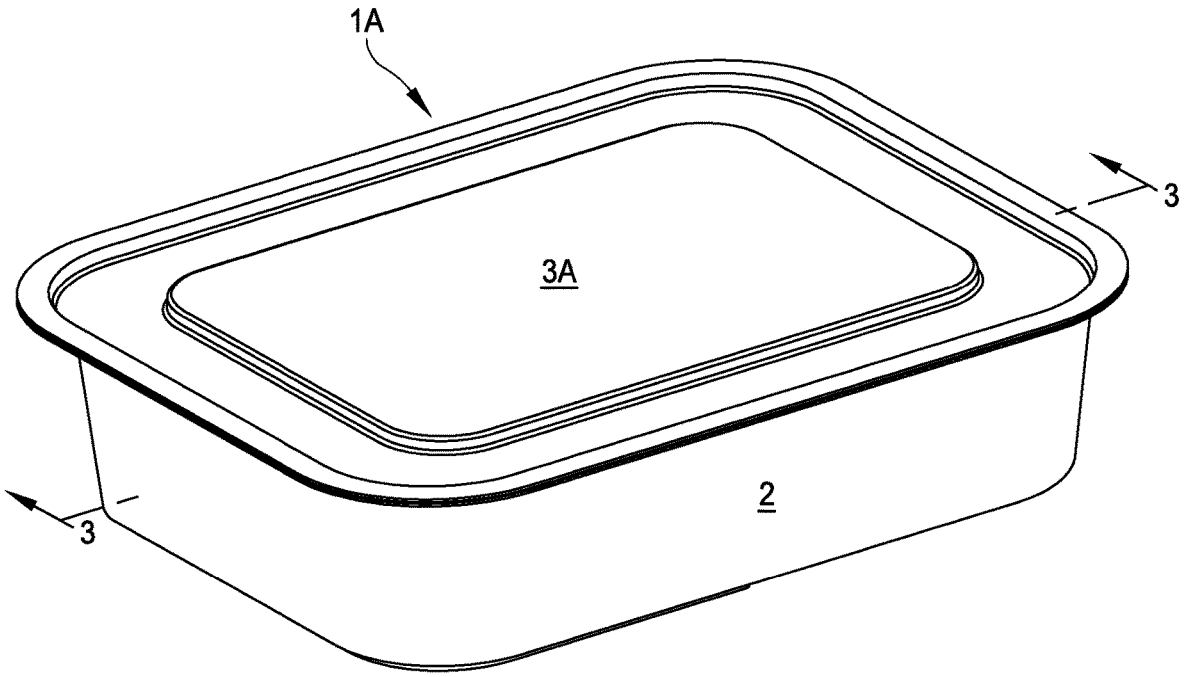
FIG. 1 is a perspective view of one of the insulator halves.
Figure 2:
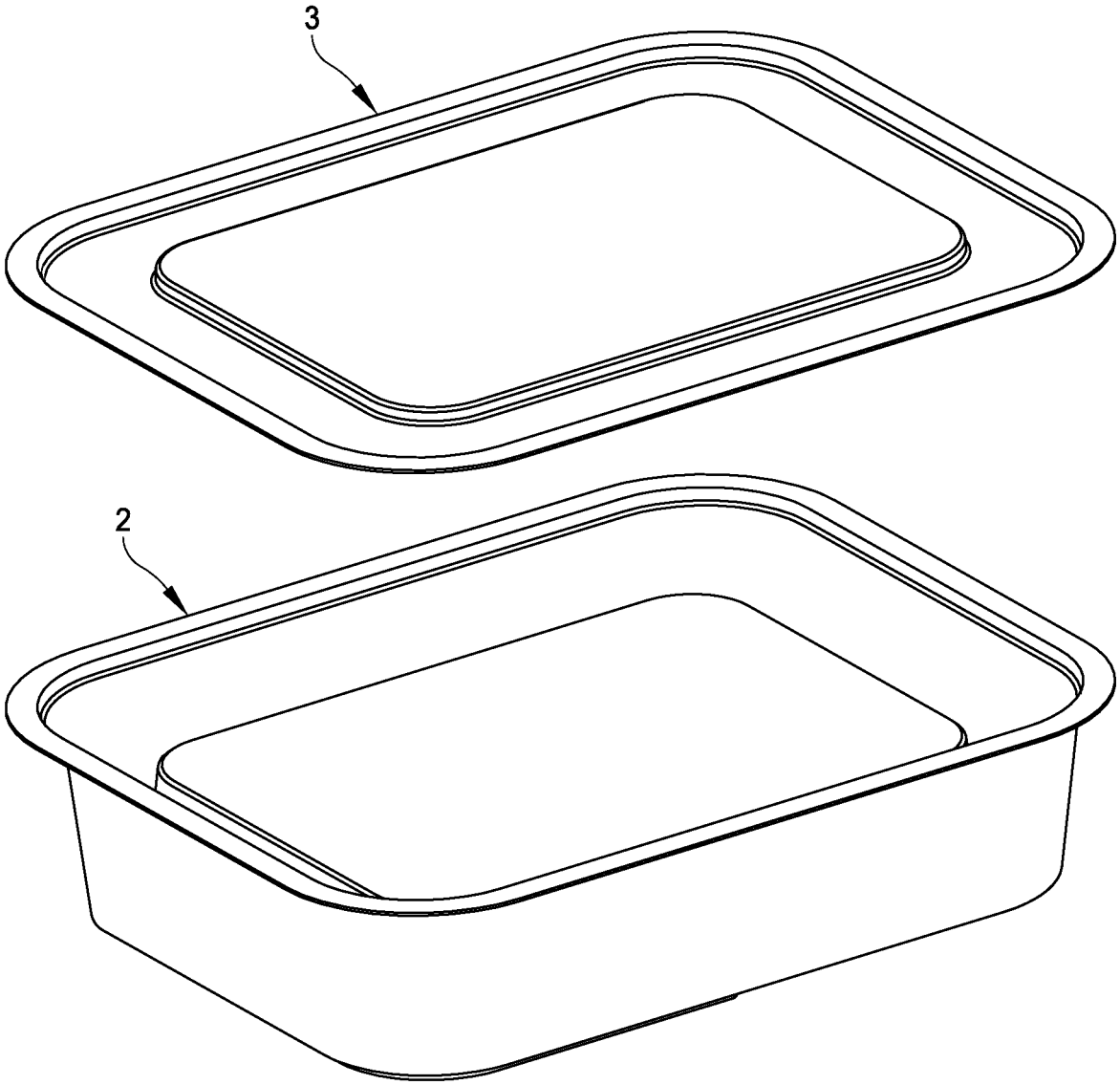
FIG. 2 is an exploded perspective view showing the separate insulator base and insulator lid.
Figure 3:
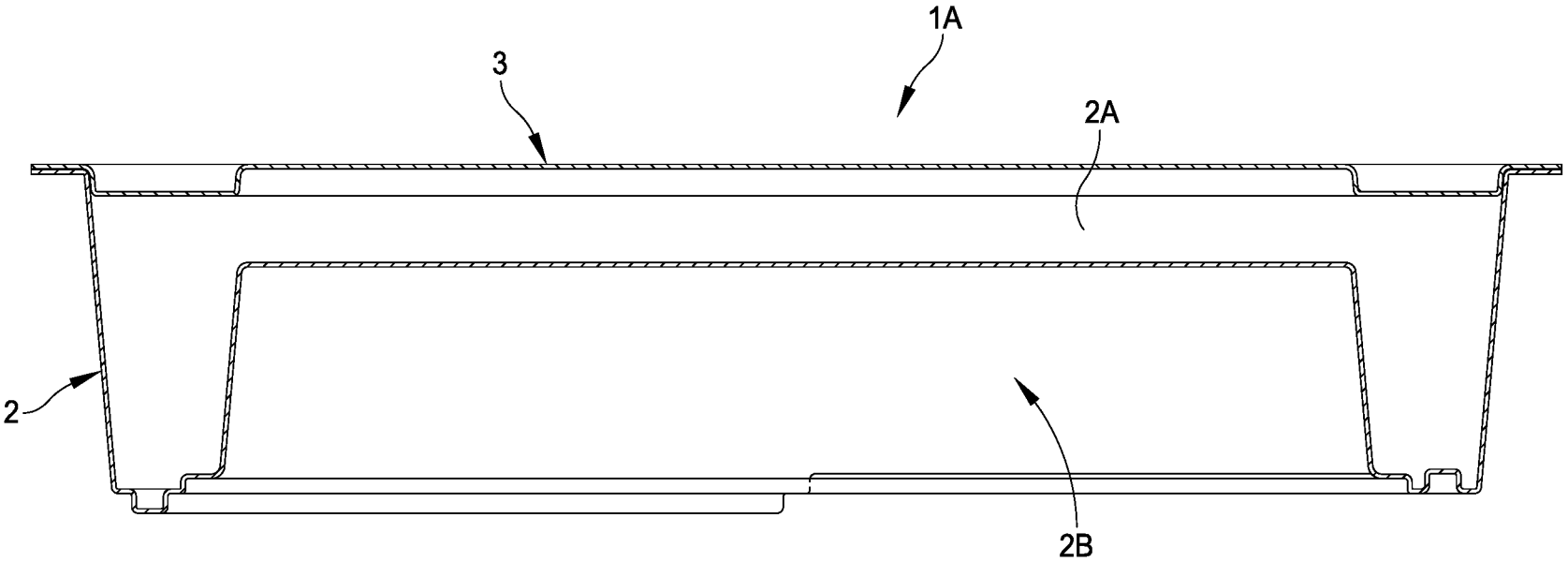
FIG. 3 is a cross-sectional view taken along line 3-3 of FIG. 1 with the lid in place over the base.
Figure 4:
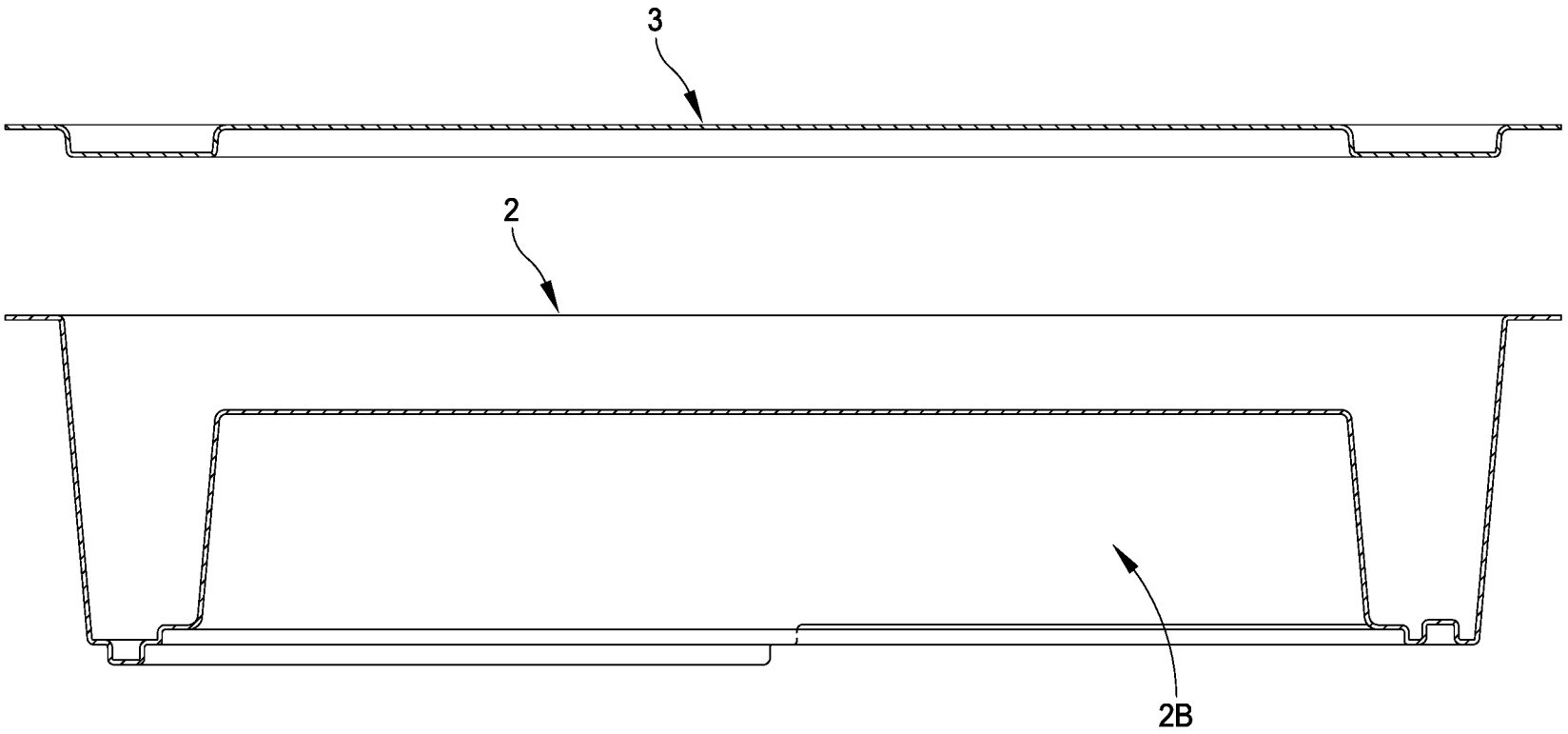
FIG. 4 is a cross-sectional view taken along line 3-3 of FIG. 1 with the lid separated away from the base
Figure 5:
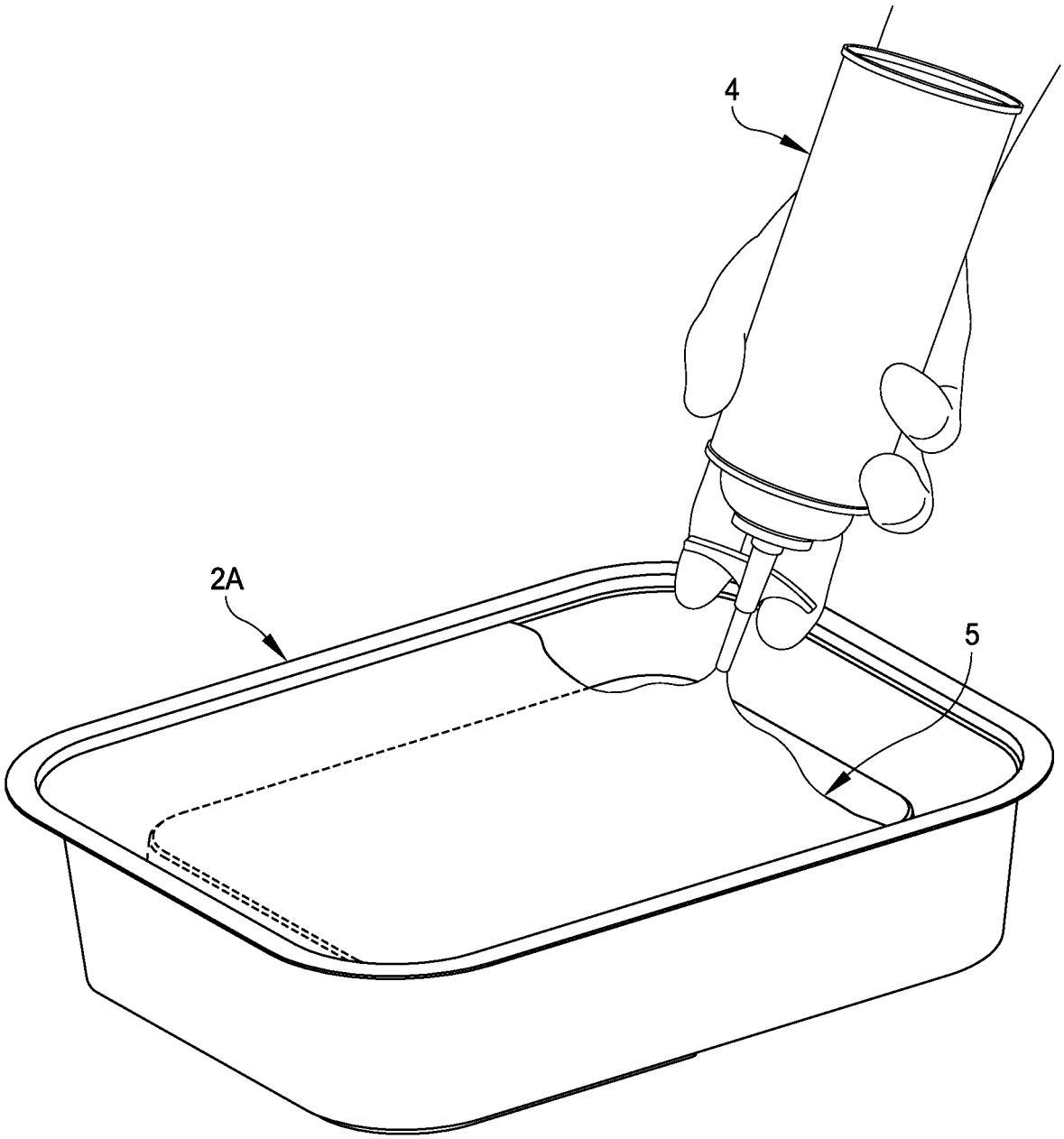
FIG. 5 is a perspective view illustrating the insertion of a foam material into the base.
Figure 6:
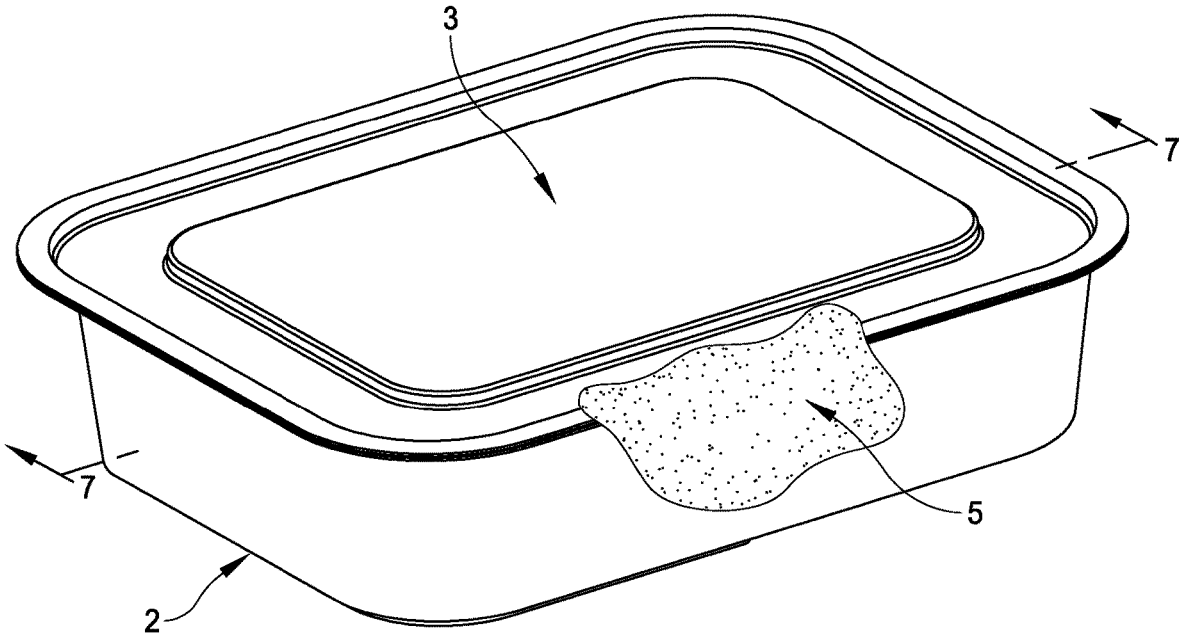
FIG. 6 is a perspective view partially cutaway to indicate that the insulator housing is completely filled with a foam material.
Figure 7:
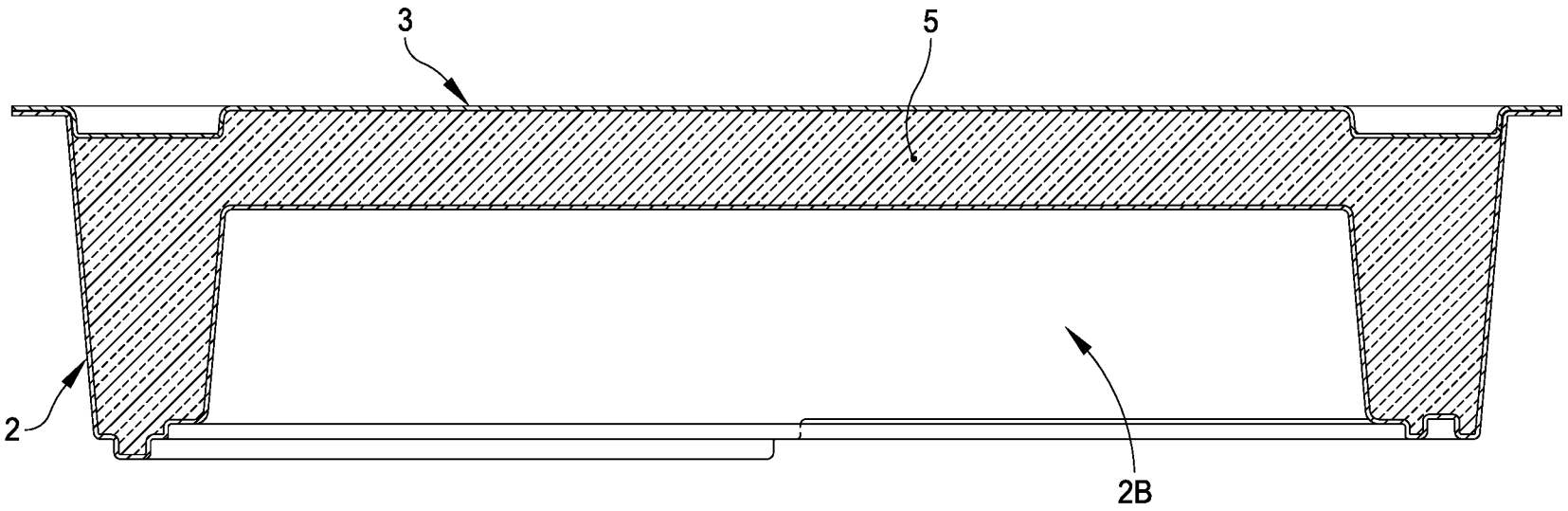
FIG. 7 is a cross-sectional view taken along line 7-7 of FIG. 6.

As indicated previously, FIGS. 1-8 illustrate the insulator 1. One half thereof is shown at 1A in FIG. 1 and the other half 1B thereof is shown in FIG. 8. The inter-engagement of both halves is clearly illustrated in FIGS. 23 and 24. FIG. 5 illustrates the interior of the base 2A being filled with a foam material 5. FIGS. 6 and 7 illustrate the lid 3 in place and sealed with the base 2. The interior space is completely filled with a foam material 5.

Figure 13:
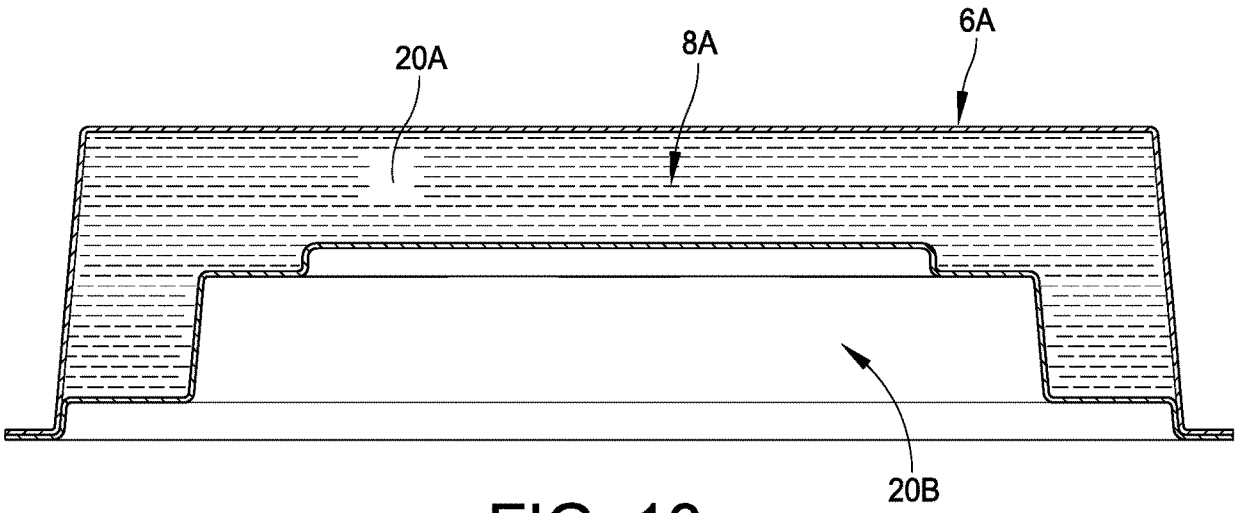
FIG. 13 is a cross-sectional view taken along line 13-13 of FIG. 12.
Figure 14:
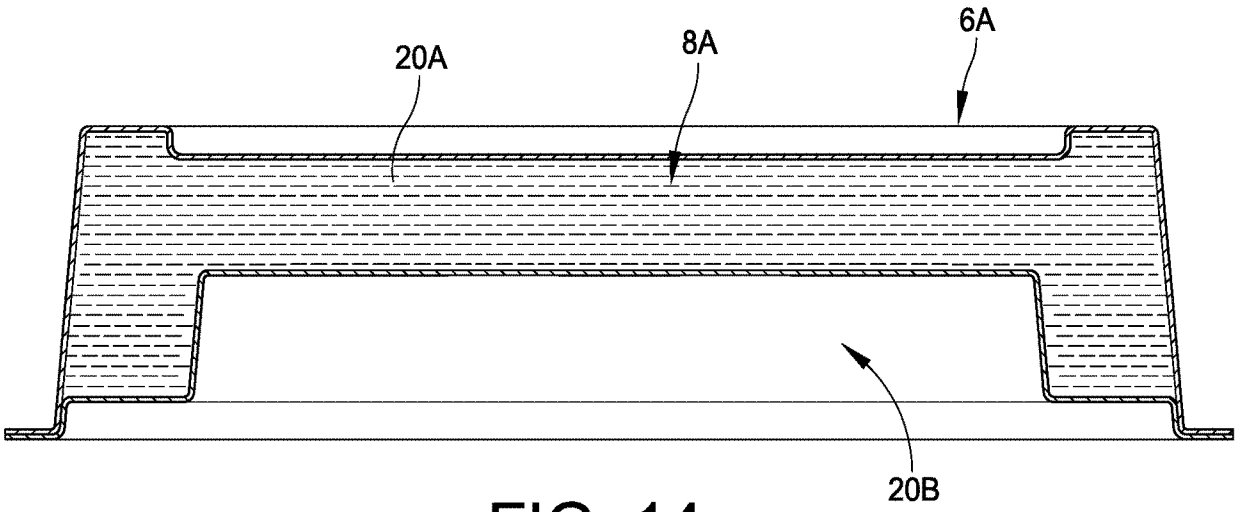
FIG. 14 is a cross-sectional view taken along line 14-14 of FIG. 12.
Figure 15:
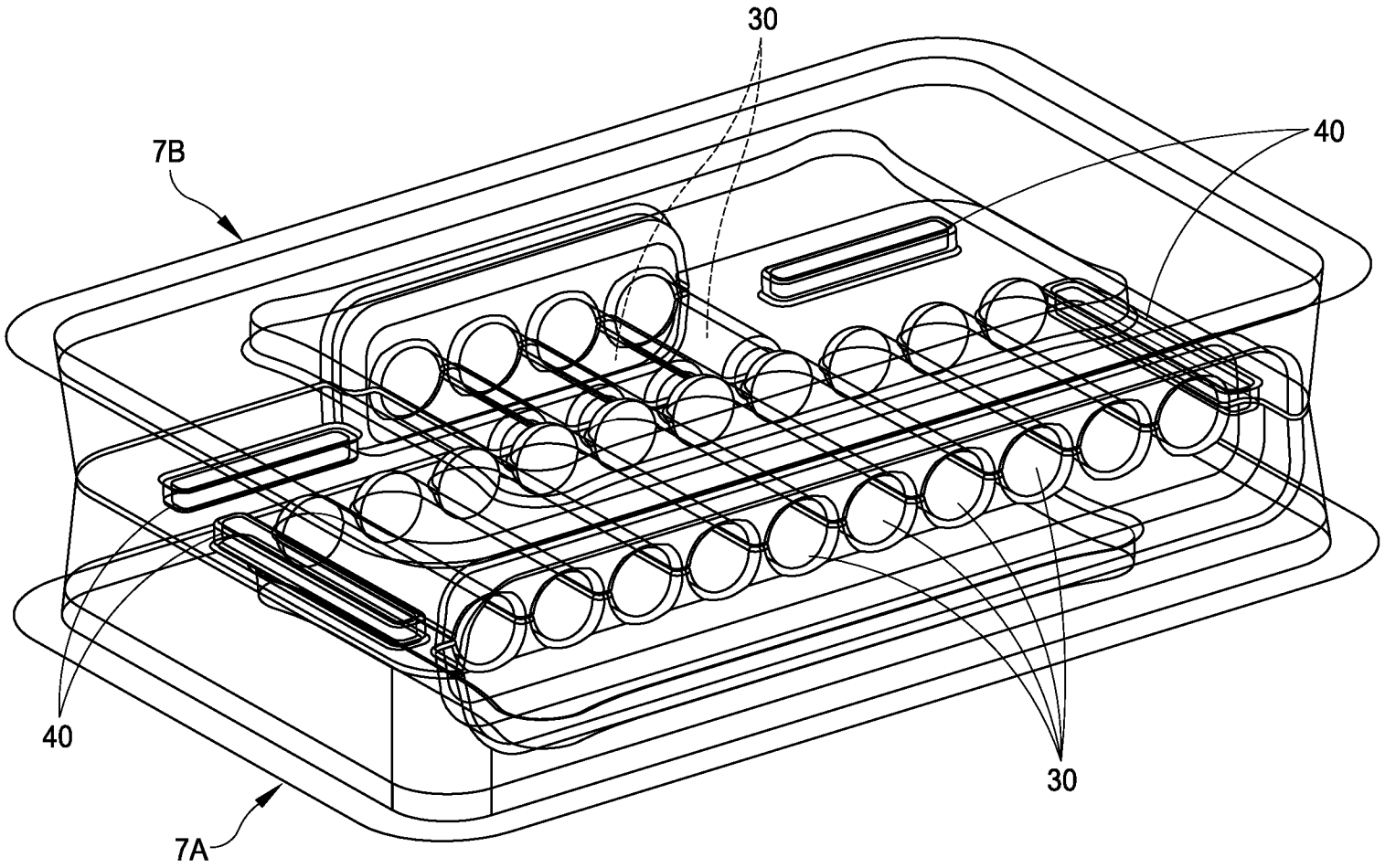
FIG. 15 is a perspective view showing both carrier halves and the vial rack.

Regarding the carrier 6, reference may be made to FIGS. 9-15 and in particular to the cross-sectional views of FIGS. 12-14. Each half of the carrier is provided with an internal space 20A that is to be filled with suppressive material. Each half is also provided with a cavity 20B into which the vial rack 7 fits. Again, reference to FIG. 24 shows the complete arrangement.

Figure 16:
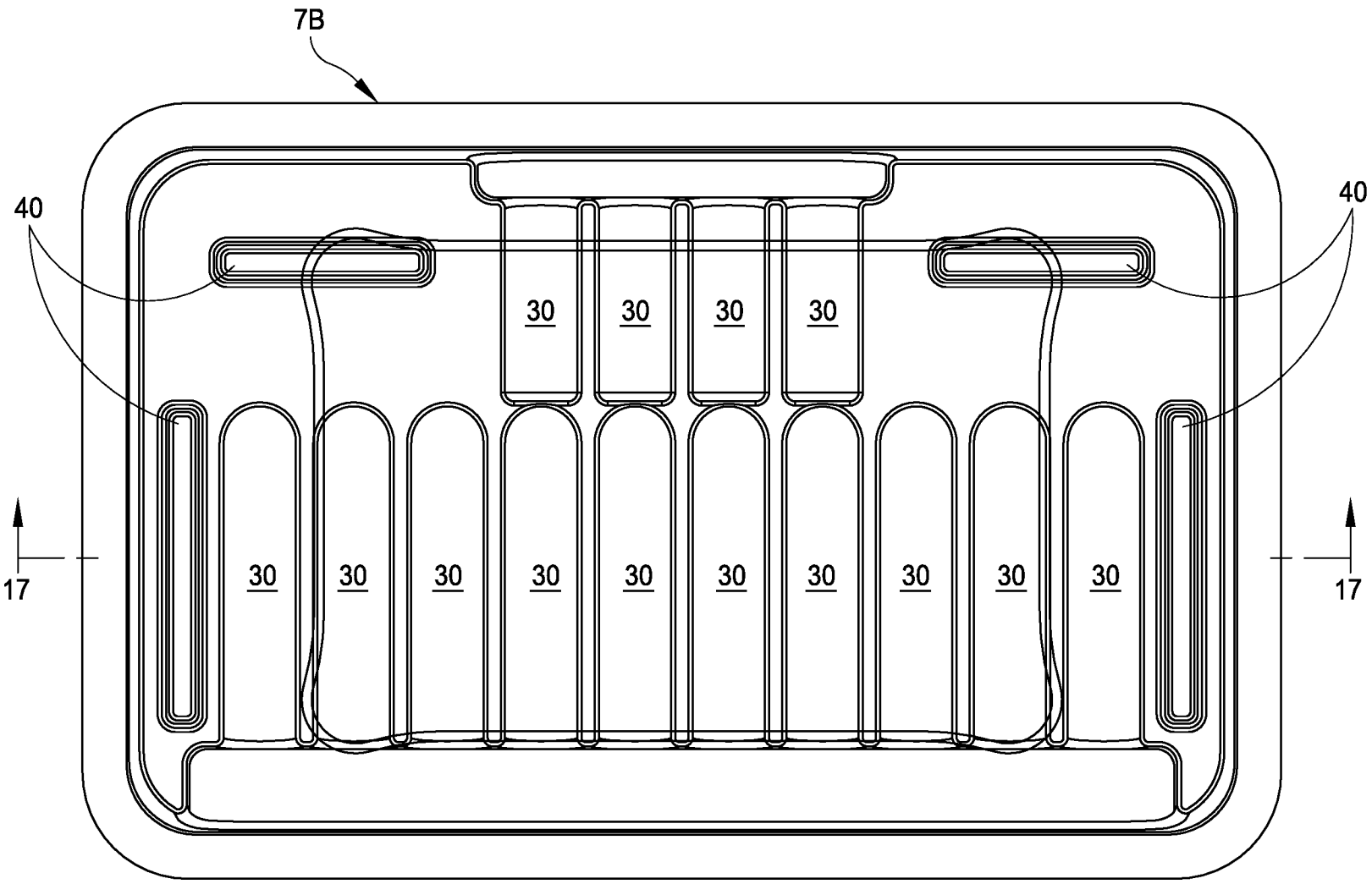
FIG. 16 is a plan view of FIG. 15.
Figure 17:
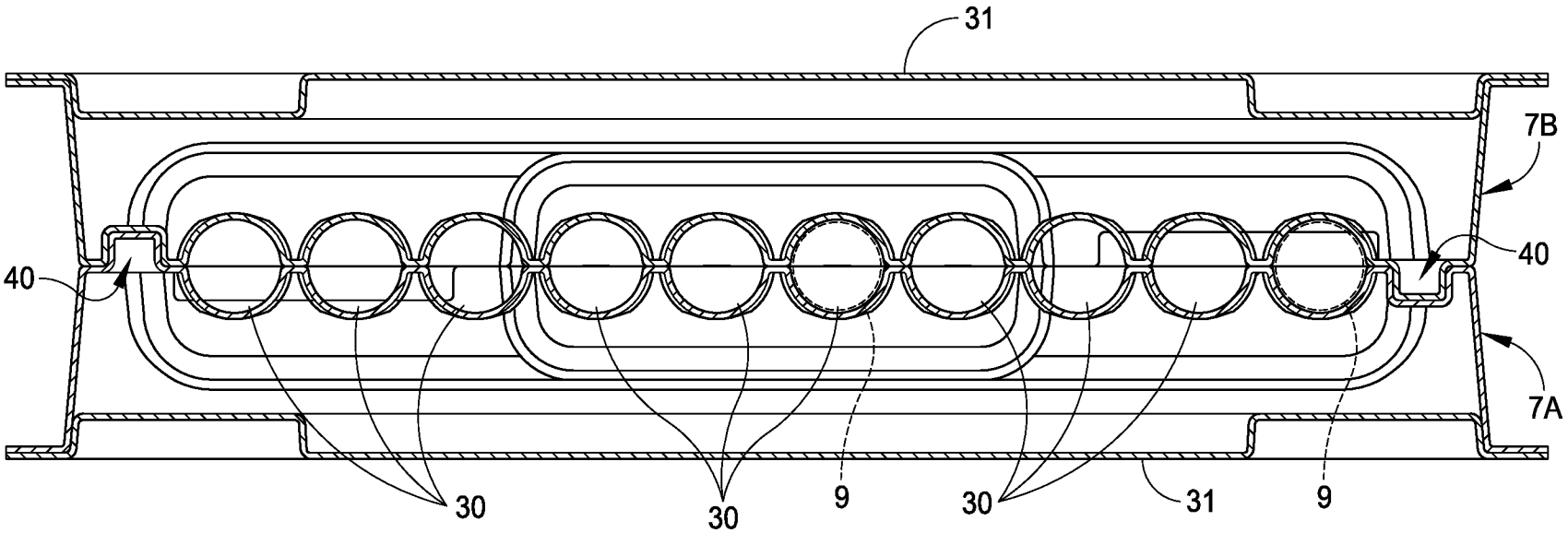
FIG. 17 is a cross-sectional view taken along line 17-17 of FIG. 16.
Figure 18:
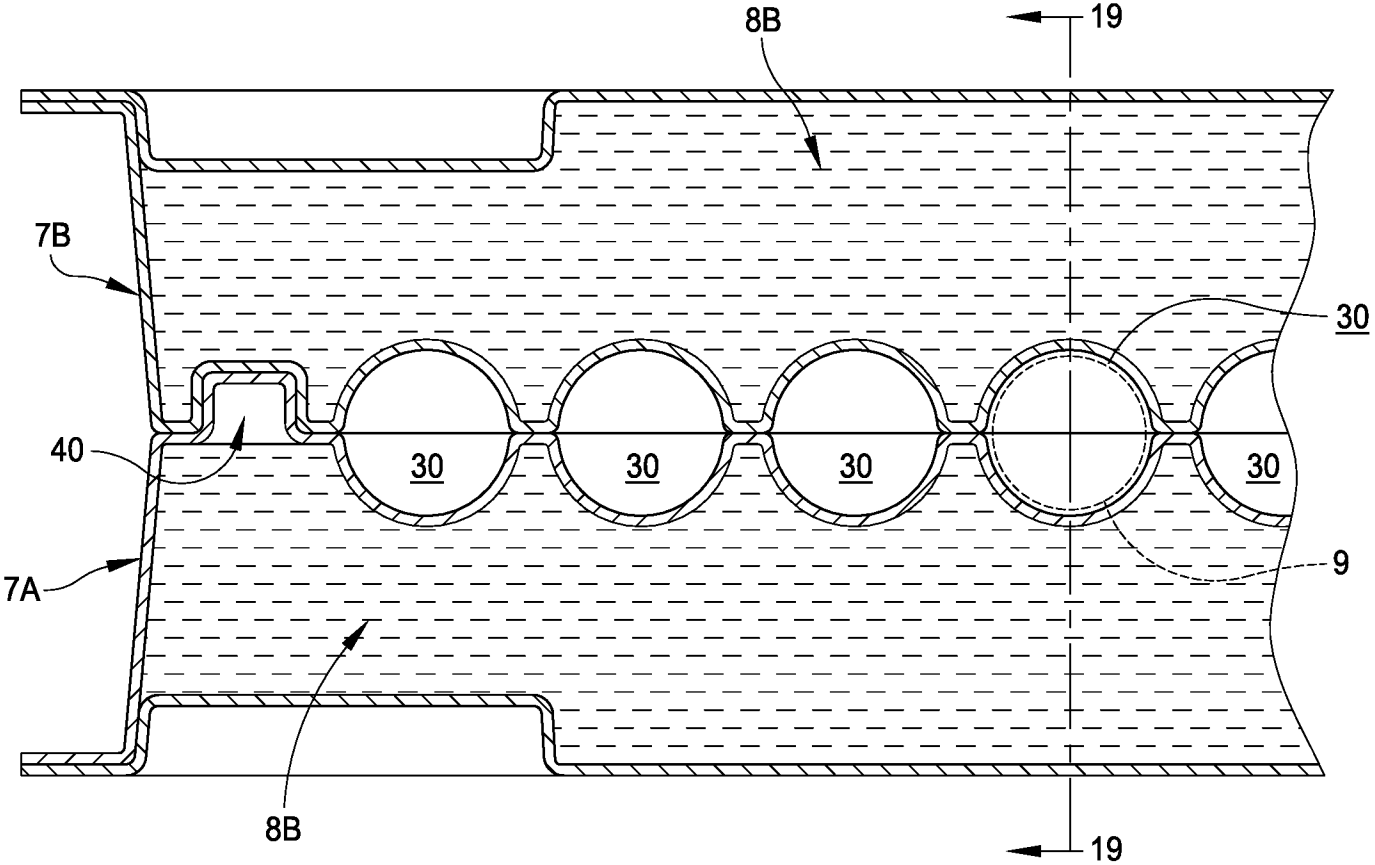
FIG. 18 is an enlarged partial cross-sectional view taken from FIG. 17.

The vial rack itself is illustrated, for example, in FIGS. 17 and 18 and includes rack halves 7A and 7B that may be interlocked by means of the glue channels 40. The layout of the glue channels is illustrated at 40 in FIG. 16. FIG. 16 also illustrates a series of side by side passages 30. This particular embodiment shows some of the passage on one side are longer than on the other side. As indicated previously, these passages are specifically dimensioned so that they firmly hold a vial while at the same time allowing a portion of the vial to extend therefrom such as shown in the detailed cross-sectional view of FIG. 19A. This enables one to insert the vial in place while allowing an end thereof to extend for the purpose of accessing the vial.

In use the vials are first inserted into the passages 30 of the vial rack. Next the rack is then surrounded by the carrier halves to provide a compact structure with little or no internal spaces, such as shown in FIG. 24. The combination of the rack and carrier is them placed in the insulator base and the insulator top is mated over the top of the carrier, as shown in the cross-sectional view of FIG. 24. The completed assembly can then be transported in a usual manner. Refer also to the cross-sectional view of FIG. 19 which clearly illustrates how the end of the vial extends outwardly so it can be grasped for removal, while at the same time having at least 95 percent of the length of each vial or test tube within the desired insulating footprint.

The following is a table illustrating at least some of the reference numbers that are used in the drawings.

1 Insulator
2 Insulator Base
2A Insulator Base Internal Space
2B Insulator Base Recess
3 Insulator Lid
4 Insulating Foam Can
5 Insulating Foam
6 Carrier
7 Vial Rack
8 Suppressive Material
9 Vial
10 Coolant Insulation system
20A Carrier Inner Space
20B Carrier Cavity
30 Vial Passages
31 Vial Rack Cap
G Groove in the Insulator
T Tongue in the Insulator

Having now described a limited number of embodiments of the present invention, it should now be apparent to those skilled in the art that numerous other embodiments and modifications thereof are contemplated as falling within the scope of the present invention, as defined by the appended claims.

The invention claimed is:

1. A apparatus for holding one or more vials of a fluid that is to be protected, said apparatus including an insulator housing that includes separate housing halves that, when joined together, form an internal space and a recess, a two piece carrier that is disposed within the recess formed by the separate housing halves, and a vial rack supported by the two piece carrier, said vial rack having a plurality of vial passages each for accommodating an elongated vial that contains a biological substance;

wherein the vial rack is comprised of a pair of rack halves that come together to form the plurality of vial passages;

wherein each rack half forms half of each vial passage;

the vial rack has opposed sides and a first set of vial passages of the plurality of vial passages are formed in one of the opposed sides and a second set of vial passages of the plurality of vial passages are formed in another of the opposed sides;

wherein each vial is elongated in shape and has a length less than the length of an accommodating vial passage;

including matching glue channels in the respective rack halves.

2. The apparatus of claim 1 wherein each insulator housing half is comprised of an insulator base and an insulator lid that are commonly sealed about respective base and lid edges.

3. The apparatus of claim 2 wherein each insulator base has an interlocking surface oppositely disposed to the insulator lid, and the respective interlocking surfaces of the insulator base and insulator lid, when the housing halves are joined, are interlocked to maintain the housing halves in place.

4. The apparatus of claim 3 including a foam insulating material that is disposed in the internal space provided between the separate housing halves.

5. The apparatus of claim 4 wherein the interlocking surfaces include a tongue and groove engagement surface.

6. The apparatus of claim 5 wherein the tongue and groove both have interlocking surfaces that alternate along a length of each so that a segment of a groove terminates followed by a segment of a tongue thereafter and in line.

7. The apparatus of claim 1 wherein the two piece carrier is comprised of separate carrier halves each having an inner space and a cavity so that when the separate carrier halves are joined the combined cavities of the separate carrier halves are constructed and arranged to receive the vial rack therein.

8. The apparatus of claim 6 including a temperature suppressive material that is disposed in the inner space provided between the separate carrier halves.

9. The apparatus of claim 7 wherein each insulator housing half is comprised of an insulator base and an insulator lid that are commonly sealed about respective base and lid edges, wherein each insulator base has an interlocking surface oppositely disposed to the insulator lid, and the respective interlocking surfaces of the insulator base and insulator lid, when the housing halves are joined, are interlocked to maintain the housing halves in place, and including a foam insulating material that is disposed in the internal space provided between the separate housing halves.

10. The apparatus of claim 9 wherein the interlocking surfaces include a tongue and groove engagement surface.

11. The apparatus of claim 10 wherein the tongue and groove both have interlocking surfaces that alternate along a length of each so that a segment of a groove terminates followed by a segment of a tongue thereafter and in line.

12. The apparatus of claim 1 wherein the matching glue channels are disposed separate from the vial passages.

13. The apparatus of claim 10 wherein the rack halves from an internal void area and including temperature suppressive material that fills the internal void area between the rack halves.

14. The apparatus of claim 1 wherein the vial rack is comprised of a pair of rack halves that come together to form the plurality of vial passages, and that define therebetween an internal void area.

15. The apparatus of claim 14 including a temperature suppressive material that fills the internal void area between the rack halves.

* * * * *